US012398961B2

(12) United States Patent
Meyer, IV et al.

(10) Patent No.: US 12,398,961 B2
(45) Date of Patent: Aug. 26, 2025

(54) HEAT EXCHANGER DEVICE HAVING A PARTIALLY DEFORMABLE HEATED SURFACE

(71) Applicant: CELSIA TECHNOLOGIES TAIWAN, INC., Taoyuan (TW)

(72) Inventors: George A. Meyer, IV, Morgan Hill, CA (US); Chien-Hung Sun, Taoyuan (TW)

(73) Assignee: CELSIA TECHNOLOGIES TAIWAN, INC., Taoyuan (TW)

( * ) Notice: Subject to any disclaimer, the term of this patent is extended or adjusted under 35 U.S.C. 154(b) by 122 days.

(21) Appl. No.: 18/416,496

(22) Filed: Jan. 18, 2024

(65) Prior Publication Data

US 2025/0207871 A1 Jun. 26, 2025

(30) Foreign Application Priority Data

Dec. 21, 2023 (TW) ..... 112150107

(51) Int. Cl.
*F28F 3/08* (2006.01)
*F28F 3/04* (2006.01)

(52) U.S. Cl.
CPC ..... *F28F 3/08* (2013.01); *F28F 3/04* (2013.01); *F28F 2215/00* (2013.01); *F28F 2255/02* (2013.01)

(58) Field of Classification Search
CPC .. F28F 3/08; F28F 3/04; F28F 2215/00; F28F 2255/02
USPC ..... 165/166
See application file for complete search history.

(56) References Cited

FOREIGN PATENT DOCUMENTS

CA 3107250 A1 * 10/2019 ..... H01M 8/2425
TW M363017 U1 * 8/2009 ..... G06F 1/16

* cited by examiner

*Primary Examiner* — Hai H Huynh
(74) *Attorney, Agent, or Firm* — Chun-Ming Shih; HDLS IPR SERVICES

(57) ABSTRACT

A heat exchanger includes a first plate, a second plate and an elastic member. The second plate is disposed on the first plate. A chamber is defined between the first plate and the second plate. The elastic member is disposed between the first plate and the second plate. The second plate has a surrounding portion and a heated surface in the surrounding portion as one piece. A flexible portion is integrally connected between the heated surface and the surrounding portion. The flexible portion surrounds a periphery of the heated surface to hang the heated surface in the surrounding portion. The elastic member is disposed between the heated surface and the first plate as elastic support. The flexible portion can provide the heated surface ability of partial deformation to improve the contact effect between the heated surface and a surface of a heat source to maintain great heat exchange ability.

10 Claims, 3 Drawing Sheets

HEAT EXCHANGER DEVICE HAVING A PARTIALLY DEFORMABLE HEATED SURFACE

BACKGROUND

Technical Field

The disclosure relates to a heat exchanger, particularly to a heat exchanger device having a partially deformable heated surface.

Related Art

A related-art heat exchanger, such as a vapor chamber, etc., has a surface as a condensation portion and another surface as a heated portion. The heated portion is attached to a surface of a heat source to be cooled, thereby helping the heat source to dissipate heat through heat exchange.

However, since a general heat source is usually an electronic heating element fixed on a circuit board by soldering, the surface of the heat source is not always actually horizontal during the above-mentioned soldering process. Accordingly, when the heat exchanger is contacted with the surface of the heat source, it usually should be fixed to the circuit board by structures such as fasteners, so the heated portion of the heat exchanger will not always be actually horizontal. A contact error between the heating portion of the heat exchanger and the surface of the heat source is tends to be increased if the abovementioned two parts have some assembling errors respectively, this leads to a poor surface-to-surface attachment which may affect heat exchange effect.

In view of this, the inventors have devoted themselves to the above-mentioned prior art, researched intensively and cooperated with the application of science to try to solve the above-mentioned problems. Finally, the invention which is reasonable and effective to overcome the above drawbacks is provided.

SUMMARY

An object of the disclosure is to provide a heat exchanger device having a partially deformable heated surface, so that the heated surface of the heat exchanger may be partially deformed effect when contacted with a surface of a heat source to improve the face-to-face contact and ensure a good heat exchange ability.

To accomplish the above object, the disclosure provides a heat exchanger device having a partially deformable heated surface, which includes a first plate, a second plate and at least one elastic member. The second plate is disposed on the first plate. A chamber is formed between the first plate and the second plate. The elastic member is defined between the first plate and the second plate. The second plate has a surrounding portion and a heated surface in the surrounding portion. A flexible portion is integrally connected between the heated surface and the surrounding portion as one piece. The flexible portion surrounds a periphery of the heated surface to hang the heated surface in the surrounding portion. The elastic member is disposed between the heated surface and the first plate as elastic support. Thus, the flexible portion can provide the heated surface ability of partial deformation to improve the contact effect between the heated surface and a surface of a heat source to accomplish the above object.

DETAILED DESCRIPTION

The technical contents of this disclosure will become apparent with the detailed description of embodiments accompanied with the illustration of related drawings as follows. It is intended that the embodiments and drawings disclosed herein are to be considered illustrative rather than restrictive.

Figure 1:
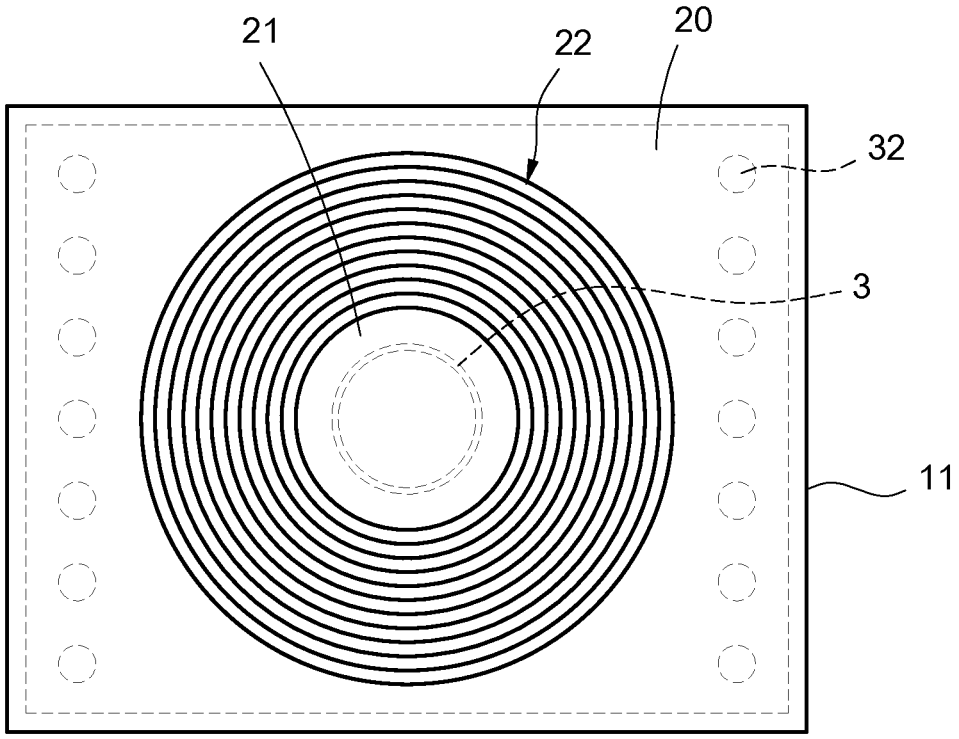
FIG. 1 is a schematic plan view of the first embodiment of the disclosure.
Figure 2:
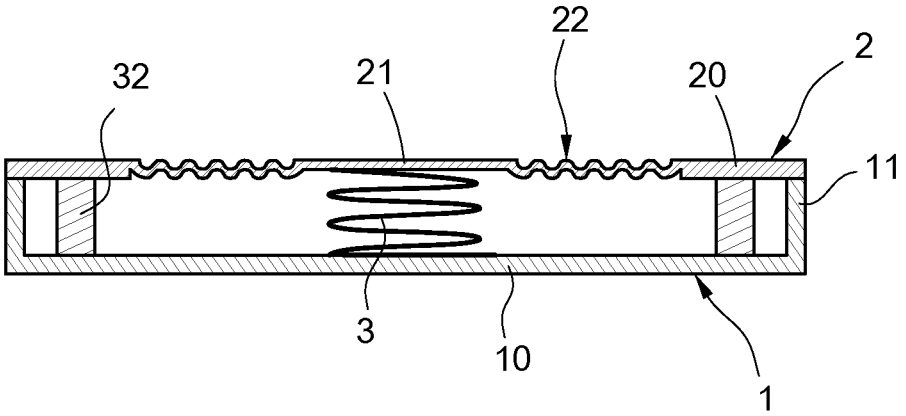
FIG. 2 is a cross-sectional view of the first embodiment of the disclosure.

Please refer to FIGS. 1 and 2, which are a schematic plan view and a cross-sectional view according to the first embodiment of the disclosure, respectively. The disclosure provides a heat exchanger device having a partially deformable heated surface, which includes a first plate 1, a second plate 2 and at least one elastic member 3 disposed between the first plate 1 and the second plate 2.

Figure 3:
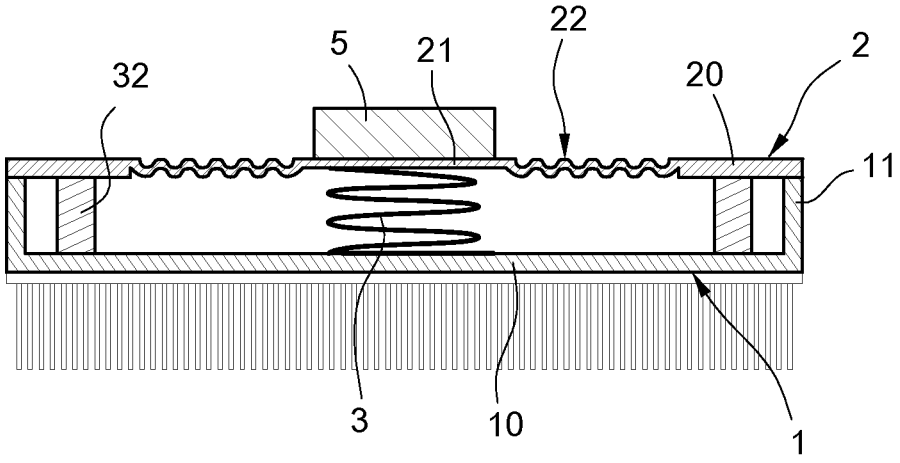
FIG. 3 is a schematic view showing an operated status of the first embodiment of the disclosure.

The first plate 1 serves as a condensation end of a heat exchanger and has a bottom portion 10 which may be used to be in contact with cooling fins 4 (as shown in FIG. 3) and a lateral portion 11 surrounding the bottom portion 10. The lateral portion 11 may match the shape of the bottom portion 10 to be formed by compassing. For example, when the bottom portion 10 appears square, the lateral portion 11 may match the geometric shape of the bottom portion 10 to appear to be a continuous bent shape and surround a periphery of the bottom portion 10.

The second plate 2 serves as a heated end of a heat exchanger and is used to cover the first plate 1. A chamber is formed between the first plate 1 and the second plate 2. The elastic member is disposed between the first plate and the second plate. In detail, the second plate 2 is used for close an opening formed at the lateral portion 11 of the first plate 1 (as shown in FIG. 2) so as to form the chamber between the first plate 1 and the second plate 2. A working fluid (not shown) may be filled in the chamber by degassing or vacuuming to serve as a medium of heat exchange.

The second plate 2 has a surrounding portion 20 and a heated surface 21 in the surrounding portion 20. A flexible portion 22 is integrally connected between the heated surface 21 and the surrounding portion 20 so that when the heated surface 21 is pressed by an external force, the flexible portion 22 surrounding its periphery may provide flexible deformation to be adaptive to being attached on a heat source 5 (as shown in FIG. 3). Furthermore, the flexible portion 22 may has a waved cross-section or appear spiral and may be formed by pressing a position of the second plate 2, which corresponds to the flexible portion 22. Such pressing makes not only the flexible portion 22 be of a waved or spiral shape, but also a thickness of the flexible portion 22 thinner to provide the heated surface 21 certain flexible deformation and maintain an integrally structural relationship between the heated surface 21 and the surrounding portion 20.

Figure 5:
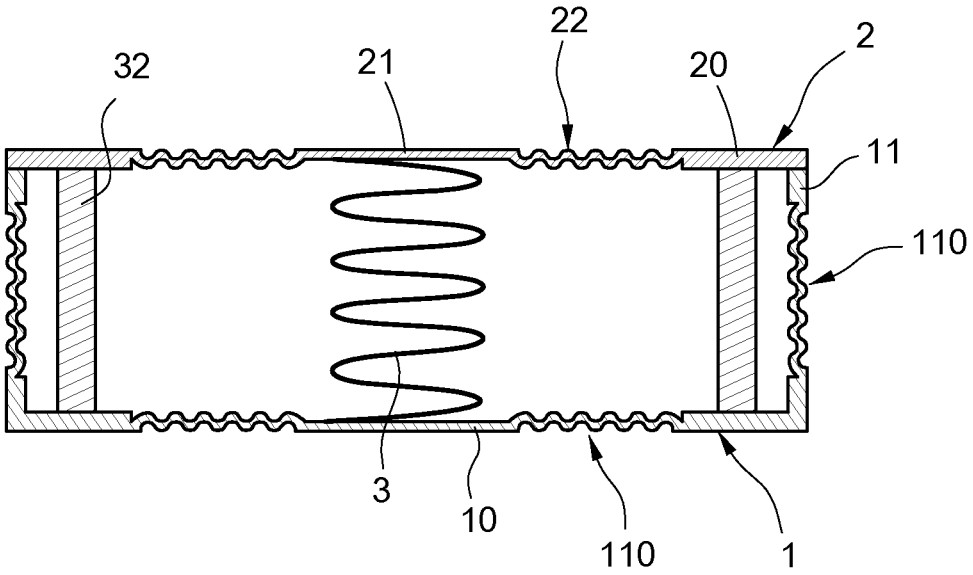
FIG. 5 is a cross-sectional view of the third embodiment of the disclosure.

The elastic member 3 is disposed between the heated surface 21 of the second plate 2 and the first plate 1 to provide the heated surface 21 to keep a horizontal position with the surrounding portion 20 while the chamber between the first plate 1 and the second plate 2 is being degassed or vacuumed and provide an elastic force to make the contact between the heated surface 21 and the heat source 5 closer when the heated surface 21 is in contact with the heat source 5 (as shown in FIG. 5). In the shown embodiment of the disclosure, the elastic member 3 may be an elastic element such as a compression spring or a conic spring, corresponds to a position under the heated surface 21, and may also be added to be multiple to jointly correspond to a position under the heated surface 21. Moreover, multiple support structures 32 may be disposed between the first plate 1 and the second plate 2. The support structures 32 are located under the surrounding portion 20 of the second plate 2 and abut against the bottom portion 10 of the first plate 1.

Therefore, the heat exchanger device having a partially deformable heated surface of the disclosure may be obtained by the aforementioned structure.

Accordingly, as shown in FIG. 3, when the disclosure is applied to a heat source 5, it can use the heated surface 21 to be attached on a surface of the heat source 5. At this time, the heated surface 21 is equivalent to being hung in the surrounding portion 20 of the second plate 2 by the flexible portion 22 at the periphery, so when being in contact with a surface of the heat source 5, the heated surface 21 may match factors such as flatness or slant of the surface of the heat source 5 and be adjusted by the flexible deformation generated by the flexible portion 22, so as to make the heated surface 21 firmly attached on the surface of the heat source 5 with a surface-to-surface manner.

Figure 4:
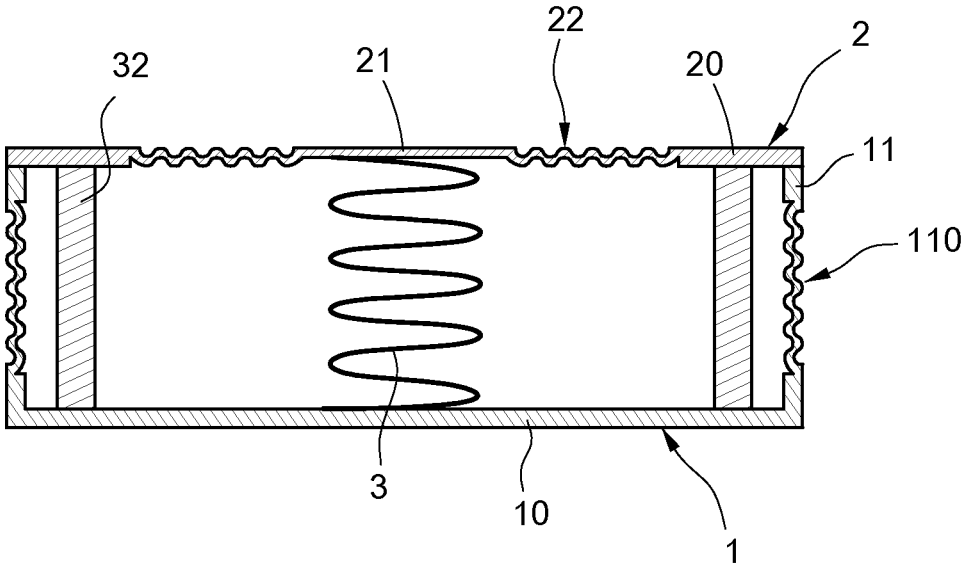
FIG. 4 is a cross-sectional view of the second embodiment of the disclosure.

In addition, as shown in FIG. 4, in the second embodiment of the disclosure, the lateral portion 11 of the first plate 1 may be further formed with at least one lateral flexible portion 110. As a result, flexible deformation may be formed between the whole second plate 2 and the first plate 1 by the lateral flexible portion 110 so that the horizontality between the first plate 1 and the second plate 2 may be fine-tuned to a more adaptive status depending upon the heat source 5.

Further, as shown in FIG. 5, in the third embodiment of the disclosure, the bottom portion 10 of the first plate 1 may be further formed with at least one bottom flexible portion 100, which may be applied to being attached on a condensation end such as a surface-to-surface contact on a larger condensation surface.

While this disclosure has been described by means of specific embodiments, numerous modifications and variations could be made thereto by those skilled in the art without departing from the scope and spirit of this disclosure set forth in the claims.

What is claimed is:

1. A heat exchanger device having a partially deformable heated surface, comprising:

a first plate;

a second plate, disposed on the first plate, and a chamber being defined between the first plate and the second plate; and at least one elastic member, disposed between the first plate and the second plate;

wherein the second plate comprises a surrounding portion and a heated surface in the surrounding portion, a flexible portion is integrally connected between the heated surface and the surrounding portion as one piece, the flexible portion surrounds a periphery of the heated surface to hang the heated surface in the surrounding portion, and the elastic member is disposed between the heated surface and the first plate for elastic supporting.

2. The heat exchanger device having a partially deformable heated surface of claim 1, wherein the first plate serves as a condensation end and the second plate serves as a heated end.

3. The heat exchanger device having a partially deformable heated surface of claim 1, wherein the first plate comprises a bottom portion and a lateral portion surrounding the bottom portion.

4. The heat exchanger device having a partially deformable heated surface of claim 3, wherein the bottom portion is disposed with multiple cooling fins.

5. The heat exchanger device having a partially deformable heated surface of claim 3, wherein the bottom portion is formed with at least one bottom flexible portion.

6. The heat exchanger device having a partially deformable heated surface of claim 3, wherein the lateral portion is formed with at least one lateral flexible portion.

7. The heat exchanger device having a partially deformable heated surface of claim 1, wherein the elastic member is multiple in number.

8. The heat exchanger device having a partially deformable heated surface of claim 1, wherein the elastic member is a compression spring or a conic spring.

9. The heat exchanger device having a partially deformable heated surface of claim 1, wherein multiple support structures are disposed between the first plate and the second plate, the support structures are located under the surrounding portion and abut against the first plate.

10. The heat exchanger device having a partially deformable heated surface of claim 1, wherein the flexible portion comprises a waved cross-section appears or is of a spiral shape.

* * * * *